US012352058B2

(12) United States Patent
Benvenuto et al.

(10) Patent No.: US 12,352,058 B2
(45) Date of Patent: Jul. 8, 2025

(54) BUILDING ASSEMBLY SYSTEM AND ASSOCIATED METHOD

(71) Applicant: BIG TIME INVESTMENT, LLC, Southfield, MI (US)

(72) Inventors: Joseph Michael Benvenuto, Monroe, MI (US); Stephen T. Houston, Rochester Hills, MI (US); Bridget C. Joseph, Farmington Hills, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 18/421,270

(22) Filed: Jan. 24, 2024

(65) Prior Publication Data

US 2024/0167291 A1 May 23, 2024

Related U.S. Application Data

(63) Continuation of application No. 17/232,177, filed on Apr. 16, 2021, now Pat. No. 11,913,242.

(51) Int. Cl.

| | |
|---|---|
| ***E04G 3/20*** | (2006.01) |
| ***E04G 3/24*** | (2006.01) |
| ***E04G 5/00*** | (2006.01) |
| ***E04G 5/04*** | (2006.01) |

(52) U.S. Cl.

CPC ..... *E04G 3/246* (2013.01); *E04G 5/007* (2013.01); *E04G 5/04* (2013.01)

(58) Field of Classification Search

CPC ..... E04G 3/246; E04G 5/007; E04G 5/04

See application file for complete search history.

(56) References Cited

U.S. PATENT DOCUMENTS

| | | | | |
|---|---|---|---|---|
| 4,611,784 | A * | 9/1986 | Gallis | E04G 11/28 249/20 |
| 10,745,906 | B1 * | 8/2020 | Houston | E04B 1/3544 |
| 10,753,080 | B1 * | 8/2020 | Houston | E04B 1/3404 |
| 10,829,928 | B2 * | 11/2020 | Houston | E04B 1/3511 |
| 10,900,218 | B2 * | 1/2021 | Houston | E04B 1/3516 |
| 11,680,399 | B2 * | 6/2023 | Houston | E04B 1/2403 52/838 |
| 2020/0080297 | A1 * | 3/2020 | Wright | E04C 3/16 |

FOREIGN PATENT DOCUMENTS

| | | | | |
|---|---|---|---|---|
| GB | 1476417 | A * | 6/1977 | E04B 1/3511 |

* cited by examiner

*Primary Examiner* — Mark R Wendell

(74) *Attorney, Agent, or Firm* — Quinn IP Law

(57) ABSTRACT

A building assembly system for fabricating a multi-story building is described, wherein the building includes a vertical support core arranged on a base. Lift jacks are arranged between a top portion and a bottom portion of the vertical support core, and a reusable bridle is suspended from the plurality of lift jacks and slidably arranged on the vertical support core. A floor plate is assembled onto the bridle at an assembly level that is proximal to the base. The plurality of the lift jacks are operable to lift the bridle and the assembled floor plate to a design elevation on the vertical support core, and are operable to lower the bridle to the assembly level on the vertical support core after the floor plate has been secured to the vertical support core at the design elevation.

16 Claims, 6 Drawing Sheets

BUILDING ASSEMBLY SYSTEM AND ASSOCIATED METHOD

CROSS-REFERENCE TO RELATED APPLICATIONS

This application is a continuation of and claims the benefit of U.S. patent application Ser. No. 17/232,177, filed on Apr. 16, 2021, the disclosure of which is hereby incorporated by reference.

TECHNICAL FIELD

The disclosure generally relates to a method, apparatus, and system for fabricating a structure.

BACKGROUND

Various methods can be employed to fabricate and construct multi-story buildings. Traditionally, multi-story buildings have been constructed from the ground up, in which construction of the building begins on a ground level by attaching higher elevation structural elements on top of previously assembled lower structural elements to construct the building in upward direction, i.e., from bottom up. Such methods may be inefficient in terms of material handling and placement. Presently, structural framing elements may be assembled into a building frame one member at a time and above ground level. Tower cranes are used during construction to execute thousands of individual lifts for elements of the structure, building enclosure, finishes, mechanical and electrical equipment and many other components of a finished building. Furthermore, concrete or another hardenable material is pumped to the final elevation of each floor. These operations may require specialized equipment and setup logistics, and may be time-consuming and labor-intensive when constructing multi-story buildings.

There is a need to provide a building fabrication method and system, and an associated fabricated building, that more effectively uses available material and labor resources.

SUMMARY

A multi-story building that includes a vertical support core and a plurality of floor plates is described, wherein fabrication of the building includes assembling each of the floor plates at or near ground level, and lifting each of the floor plates to a design elevation on the vertical support core.

This includes a building assembly system for fabricating an embodiment of the multi-story building having a vertical support core arranged on a base. Lift jacks are arranged between a top portion and a bottom portion of the vertical support core, and a reusable bridle is suspended from the plurality of lift jacks and slidably arranged on the vertical support core. A floor plate is assembled onto the bridle at an assembly level that is proximal to the base. The plurality of the lift jacks are operable to lift the bridle and the assembled floor plate to a design elevation on the vertical support core, and are operable to lower the bridle to the assembly level on the vertical support core after the floor plate has been secured to the vertical support core at the design elevation.

An aspect of the disclosure includes the bridle having lifting beams and side beams. A first of the lifting beams is arranged on a first side of the vertical support core and a second of the lifting beams is arranged on a second, opposite side of the vertical support core. The first of the lifting beams is suspended from a first set of the lift jacks, and the second of the lifting beams is suspended from a second set of the lift jacks. A first of the side beams is connected to first ends of the lifting beams, and a second of the side beams is connected to second ends of the lifting beams.

Another aspect of the disclosure includes each of the side beams having a plurality of movable bearing pads.

Another aspect of the disclosure includes the plurality of movable bearing pads being positioned to correspond to beams of the floor plate that is assembled thereon.

Another aspect of the disclosure includes the floor plate being a floor plate frame having first and second girders, a plurality of framing members, and a plurality of spandrels. The first and second girders are arranged on the plurality of movable bearing pads, the plurality of framing members are arranged transverse to and attached to the first and second girders, and the spandrels are arranged transverse to and attached to distal ends of the plurality of framing members.

Another aspect of the disclosure includes the floor plate having metal decking and hardenable material, wherein the metal decking is attached to the floor plate frame, and wherein the hardenable material is dispersed onto the metal decking.

Another aspect of the disclosure includes the bridle being disposed, at the assembly level, on top of a plurality of stub columns that are disposed on the base.

Another aspect of the disclosure includes a plurality of floor plates being sequentially assembled onto the bridle at the assembly level, wherein the lift jacks are operable to raise the bridle and one of the plurality of floor plates assembled thereon to a respective design elevation on the vertical support core; and wherein the lift jacks are operable to lower the bridle on the vertical support core after the one of the plurality of floor plates is secured to the vertical support core at its respective design elevation.

Another aspect of the disclosure includes each of the lifting beams being one of an H-beam, an I-beam, a C-beam, a T-beam, an L-beam, a square beam, or a rectangular beam.

Another aspect of the disclosure includes each of the side beams being one of an H-beam, an I-beam, a C-beam, a T-beam, an L-beam, a square beam, or a rectangular beam.

Another aspect of the disclosure includes a method for assembling a building by arranging a vertical support core on a base, assembling a plurality of lift jacks between a top portion and a bottom portion of the vertical support core, suspending a reusable bridle from the plurality of lift jacks, the bridle being slidably arranged on the vertical support core, and assembling a floor plate onto the bridle at an assembly level that is proximal to the base. The bridle and the floor plate are lifted, via the plurality of lift jacks, to a design elevation on the vertical support core, and the assembled floor plate is secured to the vertical support core at the design elevation.

Another aspect of the disclosure includes lowering, via the plurality of lift jacks, the bridle to the assembly level on the vertical support core after the floor plate has been secured to the vertical support core at the design elevation.

Another aspect of the disclosure includes arranging the bridle onto a plurality of stub columns that are arranged on the base when the bridle is lowered to the assembly level.

Another aspect of the disclosure includes assembling the bridle onto the vertical support core, arranging a first lifting beam on a first side of the vertical support core and arranging a second lifting beam on a second side of the vertical support core; arranging a first side beam on a first end of the vertical support core and arranging a second side beam on a second end of the vertical support core; connecting ends of the first side beam to first ends of the first and second lifting beams; and connecting ends of the second side beam to second ends of the first and second lifting beams.

Another aspect of the disclosure includes arranging a plurality of bearing pads onto the first side beam and the second side beam, wherein the plurality of bearing pads are positioned to correspond to girders of the floor plate.

Another aspect of the disclosure includes arranging the girders of the floor plate onto the plurality of bearing pads.

Another aspect of the disclosure includes arranging a plurality of framing members transverse to the girders to create a floor plate frame.

Another aspect of the disclosure includes installing metal decking onto the floor plate frame.

Another aspect of the disclosure includes dispersing hardenable material onto the metal decking.

Another aspect of the disclosure includes installing mechanical building elements onto the floor plate frame beneath the metal decking when the floor plate is disposed at the assembly level.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity, directional terms such as top, bottom, left, right, up, over, above, below, beneath, rear, and front, may be used with respect to the drawings. These and similar directional terms are descriptive of the figures, and not to be construed to limit the scope of the disclosure. Furthermore, the disclosure, as illustrated and described herein, may be practiced in the absence of an element that is not specifically disclosed herein.

Figure 1:
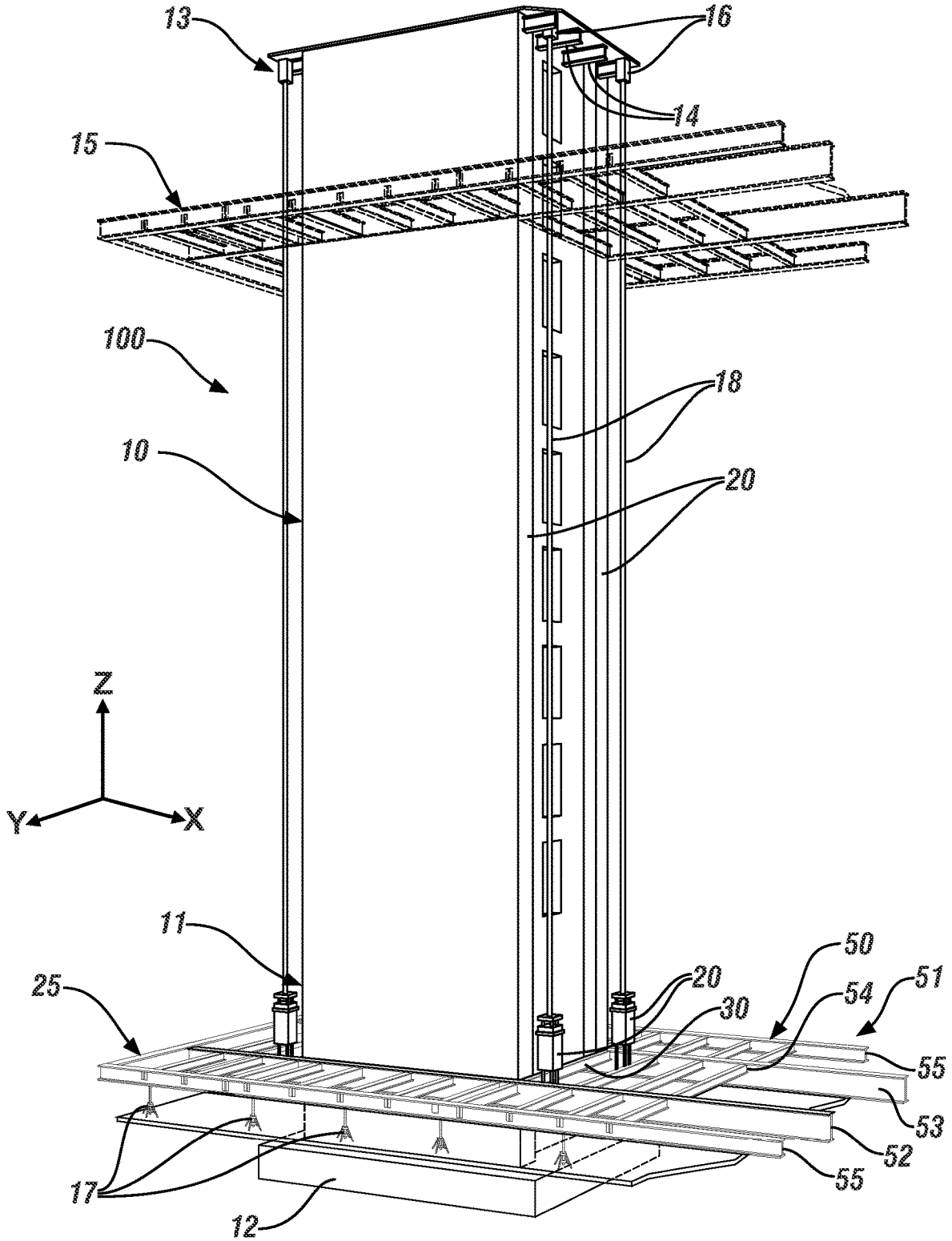
FIG. 1 is a side perspective isometric view of a partially constructed building, in accordance with the disclosure.

Referring to the Figures, wherein like numerals indicate like parts throughout the several views, FIG. 1 shows a vertical support core 10 for a building 100 that is arranged on a base 12, wherein the building 100 is fabricated employing a top-down construction process. In general, the top-down construction process includes sequentially constructing a plurality of floor plates 50 at an assembly level 25, lifting each of the floor plates 50 to a respective design elevation 15, and attaching each of the floor plates 50 to the vertical support core 10 of the building 100 in a descending order. The building 100 includes a single vertical support core 10 as shown with reference to FIG. 1, or multiple vertical support cores 710, 721 as shown with reference to FIG. 6, and a plurality of the floor plates 750.

As used herein, the term "floor plate 50" includes but is not limited to all structural or frame members, e.g., joists and/or purlins; flooring, e.g., concrete floor; interior walls; exterior curtain walls; modular room subassemblies; lavatories; mechanical building elements 70 (shown with reference to FIG. 4) etc., that form a floor or level of the building 100. The term "floor plate 50" may include a plate for a roof structure (not shown) of the building 100, as well as a plate for a floor or level of the building 100. Accordingly, the term "floor plate 50" is used herein to refer to both the roof structure for the roof of the building 100, as well as a floor structure for one of the floors or levels of the building 100. The reference numeral 50 may refer to and indicate any floor plate 50 of the building 100. The floor plate 50 specifically includes a floor plate frame 51, which is described herein.

Referring again to FIG. 1, the construction system includes the vertical support core 10, which is an element of a vertical slip form system. The vertical support core 10 is formed from multiple vertical load-bearing columns formed from steel beams, cross-members, and outer shear walls that are formed from a hardenable material. The vertical support core 10 also includes a plurality of horizontal roof beams 14 that are arranged on a top portion 13. The vertical support core 10 is designed to carry the vertical loads of the building 100. As such, the shape of the vertical support core 10 may be designed as necessary to provide the required compressive strength, shear strength, and bending strength for the particular application, size, and location of the building 100.

The hardenable material may include, but is not limited to, a concrete mixture or other similar composition. The hardenable material may include one or more additives to enhance one or more physical characteristics of the hardenable material, such as to reduce curing time, reduce slump, increase strength, etc. The specific type and contents of the hardenable material 64 may be dependent upon the specific application of the building 100, and may be dependent upon the specific geographic region in which the building 100 is being constructed. The specific type and contents of the hardenable material are understood by those skilled in the art, and are not described in detail herein.

A plurality of lift jacks 16 are attached to the roof beams 14 of the vertical support core 10, and are employed to lift the floor plates 50 to their respective design elevations 151, which is illustrated in dashed lines. Referring again to FIG. 1, the lift jacks 16 may include, but are not limited to a plurality of strand jacks. Alternatively, the lift jacks 16 may include other devices capable of lifting each of the floor plates 50 of the building 100. Strand jacks are able to grasp and move a cable to lift heavy objects. The specific features and operation of lift jacks 16 such as strand jacks are known to those skilled in the art. The lift jacks 16 couple to a bridle 30 via cables 18 and lockable joints 20.

As shown, each of plurality of the floor plates 50 can be assembled on the bridle 30, which is placed at an assembly level 25 that is at or proximal to ground elevation. The plurality of the floor plates 50 are lifted to their respective design elevations 151 relative to the vertical support core 10 in a sequential descending order employing the lift jacks 16.

The bridle 30 is arranged around an outer periphery of the vertical support core 10 and is attachable to and suspended from the lift jacks 16 via cables 18 and lockable joints 20. The bridle 30 is a reusable device that can be employed to support each floor plate 50 during assembly at the assembly level 25. The bridle 30 is also used to support each floor plate 50 when the respective floor plate 50 is being lifted by the lift jacks 16 and secured to its respective design elevation 151. The bridle 30 is lowered by the lift jacks 16 to the assembly level 25 after the respective floor plate 50 is secured to its respective design elevation 151. The bridle 30 is then re-used to support another of the floor plates 50 during assembly. As shown with reference to FIG. 4, the bridle 30 is supported on a plurality of stub columns 22 that are arranged on the base 12 around the outer periphery of the vertical support core 10 when it is at the assembly level 25 proximal to the ground elevation.

Figure 2:
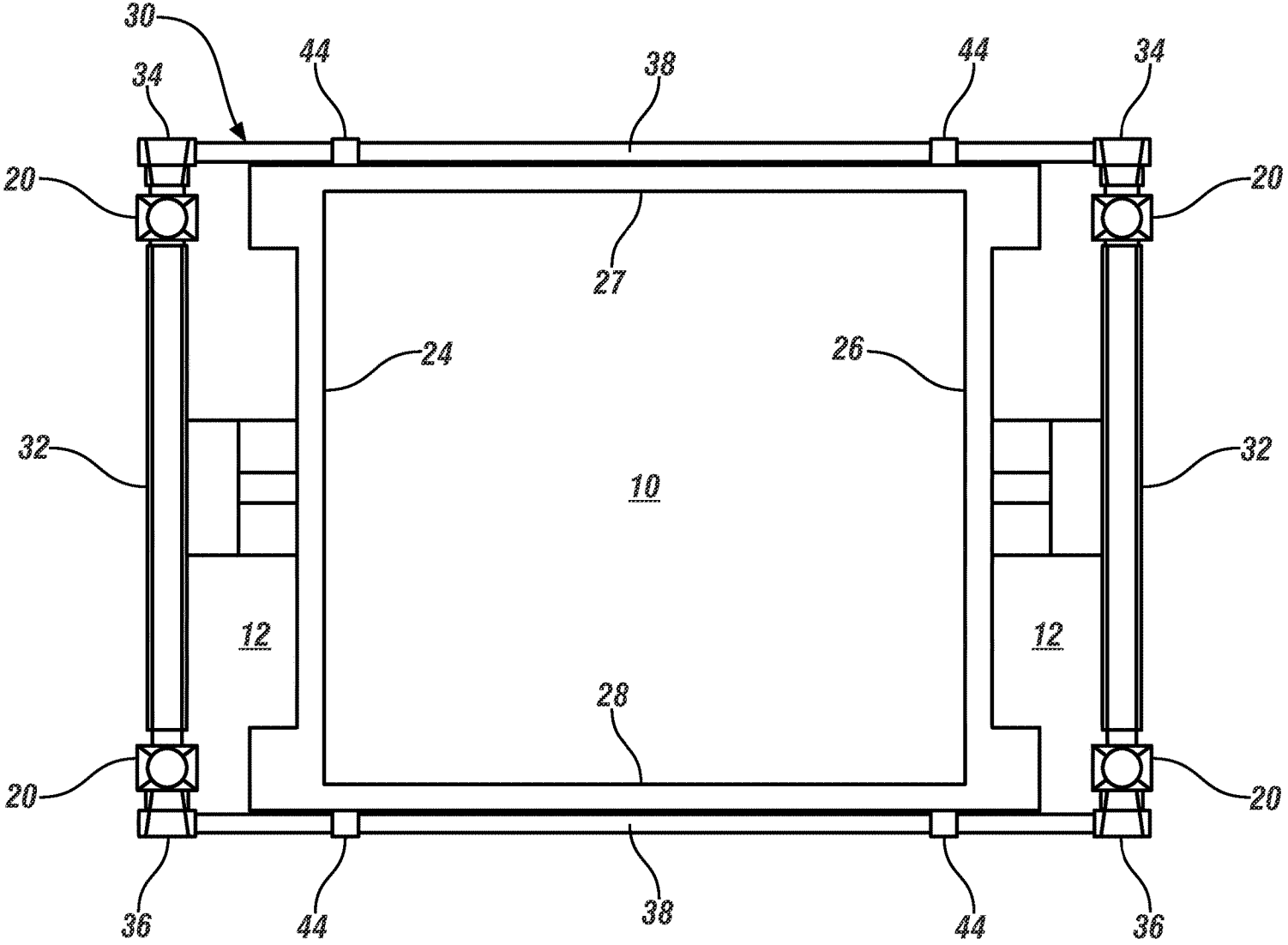
FIG. 2 is a plan view of an embodiment of a bridle employable in fabricating an embodiment of the building described with reference to FIG. 1, in accordance with the disclosure.

FIG. 2 schematically illustrates a top plan view of an embodiment of the bridle 30 and the vertical support core 10 arranged on the base 12. Elements of the vertical support core 10 include a first side 24, a second side 26, a first end 27, and a second end 28. The bridle 30 includes lifting beams 32 and side beams 38 that are arranged around the outer periphery of the vertical support core 10. The lifting beams 32 are attached to and suspended from the lift jacks 16. When the vertical support core 10 has a rectangular cross-section, e.g., as shown, a first of the lifting beams 32 is suspended from a first set of the lift jacks 16 on the first side 24 of the vertical support core 10, and a second of the lifting beams 32 is suspended from a second set of the lift jacks 16 on the second side 26 of the vertical support core 10 that is opposite to the first side 24. A first of the side beams 38 is arranged on a first end 27 of the vertical support core 10 and is connected to first ends 34 of the lifting beams 32. A second of the side beams 38 is arranged on a second, opposite end 28 of the vertical support core 10 and is connected to second ends 36 of the lifting beams 32. The side beams 38 and the lifting beams 32 are arranged such that upper surfaces of the opposed lifting beams 32 are level with upper surfaces of the opposed side beams 38 in a horizontal plane. A plurality of bearing pads 44 are assembled onto the first and second side beams 38 for placement of girders 52, 53 (as best shown with reference to FIG. 3) of the floor plates 50 during assembly. Alternatively, the plurality of bearing pads 44 can be assembled onto the first and second lifting beams 32 for placement of the girders 52, 53 of the floor plates 50 during assembly.

The floor plates 50 make up discrete sections of the building 100. Each of the floor plates 50 is assembled at the assembly level 25, which is advantageously a few feet above ground level on top of the bridle 30. Each of the floor plates 50 is lifted to its design elevation 151 employing the lift jacks 16 or other vertical conveyance structure(s), and permanently affixed to and supported by the vertical support core 10. The floor plates 50 are cantilevered from the lift jacks 16 and therefore, the weight of each of the floor plates 50 is best distributed symmetrically around the vertical support core 10 and the lift jacks 16. The floor plates 50 may be designed asymmetrically around the lift jacks 16 so long as proper design and loading techniques are utilized.

Figure 3:
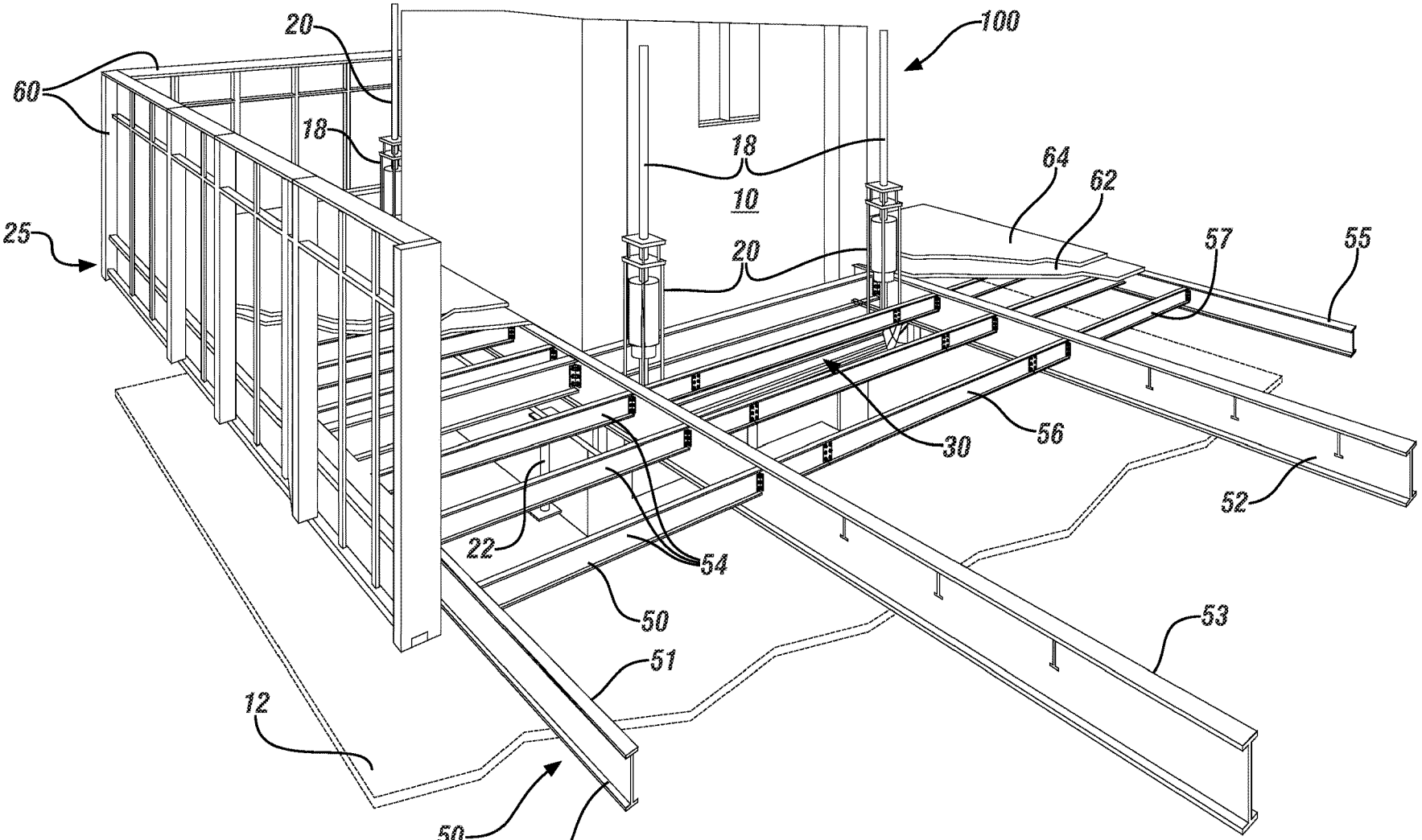
FIG. 3 is top-side perspective isometric view of a partially assembled floor plate for a building, in accordance with the disclosure.

Referring now to FIG. 3, a top-side perspective isometric view of a cutaway of an embodiment of the floor plate 50 is shown. The floor plate 50 has a floor plate frame 51, which is a woven structure that is assembled and is in the form of main framing members e.g., first and second girders 52, 53, a plurality of transversely-oriented continuous framing members 54, and in one embodiment, spandrels 55. Sidewalls 60 including walls, glass, windows, decks, railings, etc., are assembled to the spandrels 55. The girders 52, 53 are supported on the plurality of bearing pads 44 that are assembled onto the first and second side beams 38 of the bridle 30. The continuous framing members 54 are arranged to penetrate the first and second girders 52, 53 and are supported at multiple points with preset cambers. Camber is defined as a deviation from a flat, level, horizontal plane. Each of the continuous framing members 54 is an assembled part that includes a medial beam 56 and first and second cantilevered beams 57, 58. This arrangement results in a floor assembly that is strong, and thus can be exploited to reduce beam depth without increasing vertical deflection. The floor plate frame 51 imparts precise amounts of camber at junctions. The junctions may be formed employing friction bolts and plates at inflection points to meet camber requirements. The combination of bolted, four-sided junctions in the floor plate frame 51 creates an efficient and flexible roof and floor plate structure that may be adjusted for camber control during assembly. The floor plate frame 51 maximizes the strength of the transverse members, e.g., framing members 54, permitting beam depth to be minimized. Weight and overall depth of the floor plates 50 is thereby minimized. Furthermore, openings in first and second girders 52, 53 that permit the transversely-oriented framing members 54 to penetrate are cut to close tolerances, providing bracing at locations of penetrations. This bracing may prevent unintended rotation of the transverse members during assembly even before any junctions have been installed.

FIGS. 1-4 show various features of the building 100, the vertical support core 10, the bridle 30, and the floor plate 50 when disposed at the assembly level 25 near the ground elevation 14. The floor plate 50 includes the first and second girders 52, 53 that are arranged in parallel and slidably disposed on opposed sides of the vertical support core 10 in a manner that permits and facilitates vertical conveyance. Each of the first and second girders 52, 53 includes a vertically-oriented web portion and a flange portion. The first and second girders 52, 53 may each be configured, by way of non-limiting examples as an I-beam, a C-beam, a T-beam, an L-beam, a square beam, a rectangular beam, etc., and are fabricated from steel in one embodiment. A plurality of apertures are formed in the vertically-oriented web portions, and are configured to accommodate insertion of one of the first and second cantilevered beams 57, 58. The first and second girders 52, 53 are disposed on bearing pads 44 of the side beams 38 of the bridle 30, which is resting on a plurality of stub columns 22 that are disposed on an assembly pad that is fabricated on the base 12.

A plurality of the continuous framing members 54 are disposed transverse to the first and second girders 52, 53. Each of the framing members 54 includes the medial beam 56 that is attached to the first and second cantilevered beams 57, 58, and is arranged transverse to and supported by the first and second girders 52, 53. The medial beam 56 and the first and second cantilevered beams 57, 58 are each configured to have a flat beam section on a top portion of the respective beam along its longitudinal axis. The medial beam 56 may be configured as an I-beam, a C-beam, a T-beam, an L-beam, a square beam, a rectangular beam, etc., which defines a respective cross-sectional shape. The medial beam 56 includes first and second ends, with a plurality of bolt through-holes disposed thereat. Each of the first and second cantilevered beams 57, 58 may be an I-beam, a C-beam, a T-beam, an L-beam, a square beam, a rectangular beam, etc., which defines a respective cross-sectional shape.

The cross-sectional shape associated with the first cantilevered beam 57 corresponds to a respective aperture in the first girder 52, and the cross-sectional shape associated with the second cantilevered beam 58 corresponds to a respective aperture in the second girder 53. The medial beams 56 are horizontally disposed between the first and second girders 52, 53. The length of each of the medial beams 56 is selected to define inflection points. Distal ends of the first and second cantilevered beams 57, 58 are attached to spandrels 55 in one embodiment. Distal ends of the first and second cantilevered beams 57, 58 may be supported on pedestals 17, which can be installed on the base 12 and height-adjusted as required to maintain the required geometry during assembly of the floor plate 50 and placement and curing of the hardenable material 64. When each of the floor plates 50 is lifted and locked into its permanently supported position at its design elevation 151, the achieved flatness is measured and outcomes may be used to adjust the geometry of the next one of the floor plates 50 being fabricated. This process improves the flatness tolerance of each successive floor plate.

FIG. 3 further shows a cutaway portion of the metal decking 62 that is attached onto the floor plate frame 51. The metal decking 62 provides a lower plate on which hardenable material 64 can be poured during fabrication. This approach to assembling the floor plate 50 may achieve improved surface flatness tolerances by facilitating the accurate simulation of each floor plate's permanent support condition of during grade-level fabrication.

Figure 4:
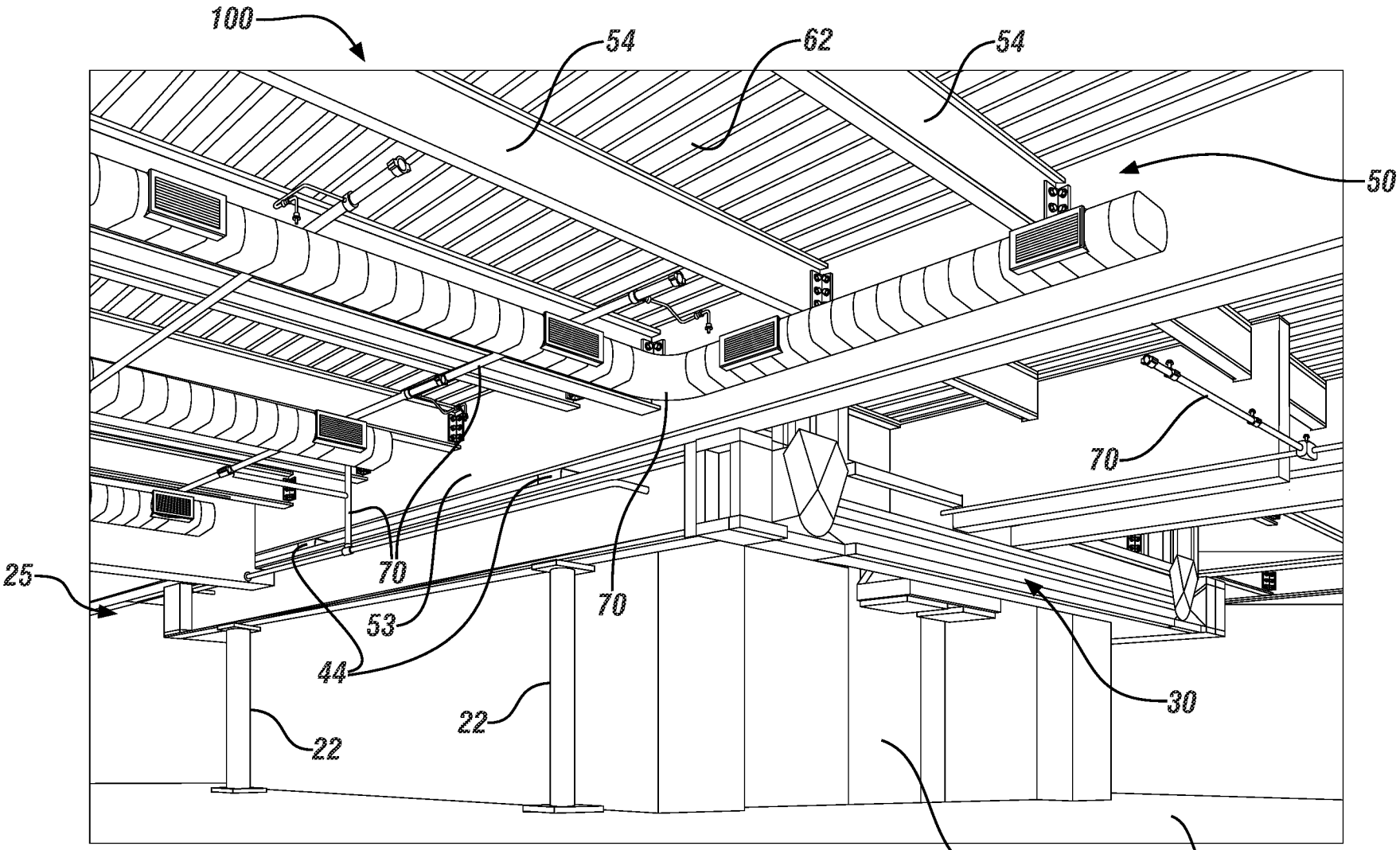
FIG. 4 is a bottom-side perspective isometric view of a floor plate for a building including mechanical elements, in accordance with the disclosure.

FIG. 4 provides a bottom-side perspective isometric view of the building 100 including vertical support core 10, bridle 30, and floor plate 50 including metal decking 62 at the assembly level. The bridle 30 is resting on stub columns 22 that are arranged on the base 12.

Mechanical building elements 70 are assembled onto the floor plate frame of the floor plate 50 beneath the metal decking 62. The mechanical building elements 70 include, e.g., plumbing, HVAC, electrical, communication, and fire suppression elements.

Figure 5:
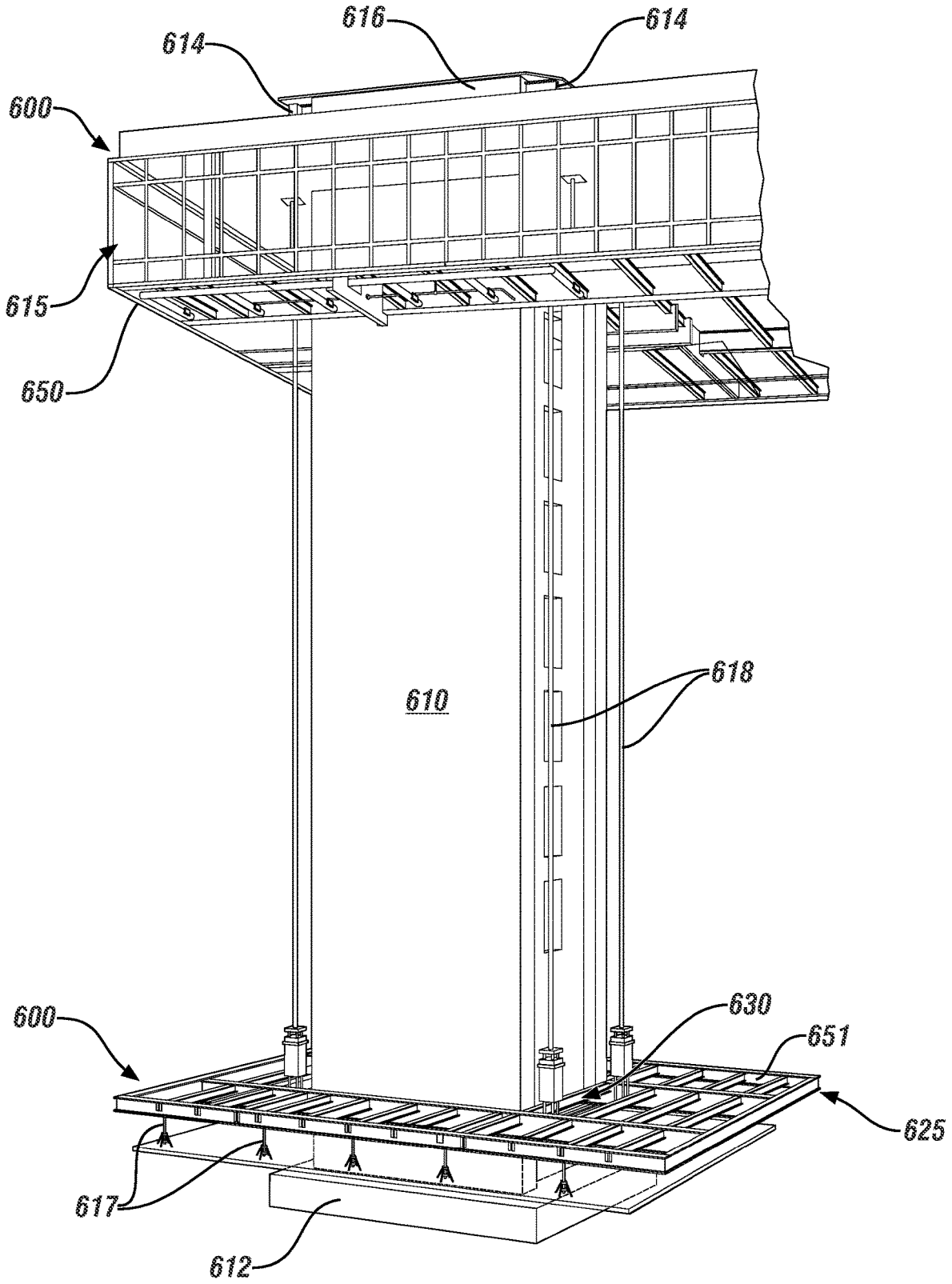
FIG. 5 is a side perspective isometric view of a partially constructed building, in accordance with the disclosure.

FIG. 5 schematically illustrates a partially assembled building 600 that is analogous to the building 100 shown with reference to FIG. 1, et seq. The building 600 includes a vertical support core 610 that projects upwardly from base 612. A first, fully assembled floor plate 650 is arranged on the vertical support core 610 at its design elevation 615. A second, partially assembled floor plate 651 is disposed at an assembly level 625, on the bridle 630, which is supported on the vertical support core 610. The partially assembled building 600 includes roof beams 616 from which lifting jacks 614 are suspended via cables 618. The lifting jacks 614 are attached to bridle 630. As shown, the bridle 630 has been lowered to the assembly level 625 and is resting upon a plurality of stub columns, and a second, partially-assembled floor plate 651 is supported on a plurality of pedestals 617 during at least a portion of its assembly. As shown, the second floor plate 651 is assembled onto the bridle 630 that is suspended from the lifting jacks 614. The second floor plate 651 is assembled at the assembly level 625 and is lifted to its design elevation 615 beneath the first floor plate 650 on the first vertical support core 610 by actions of the lifting jacks 614 and the bridle 630.

Figure 6:
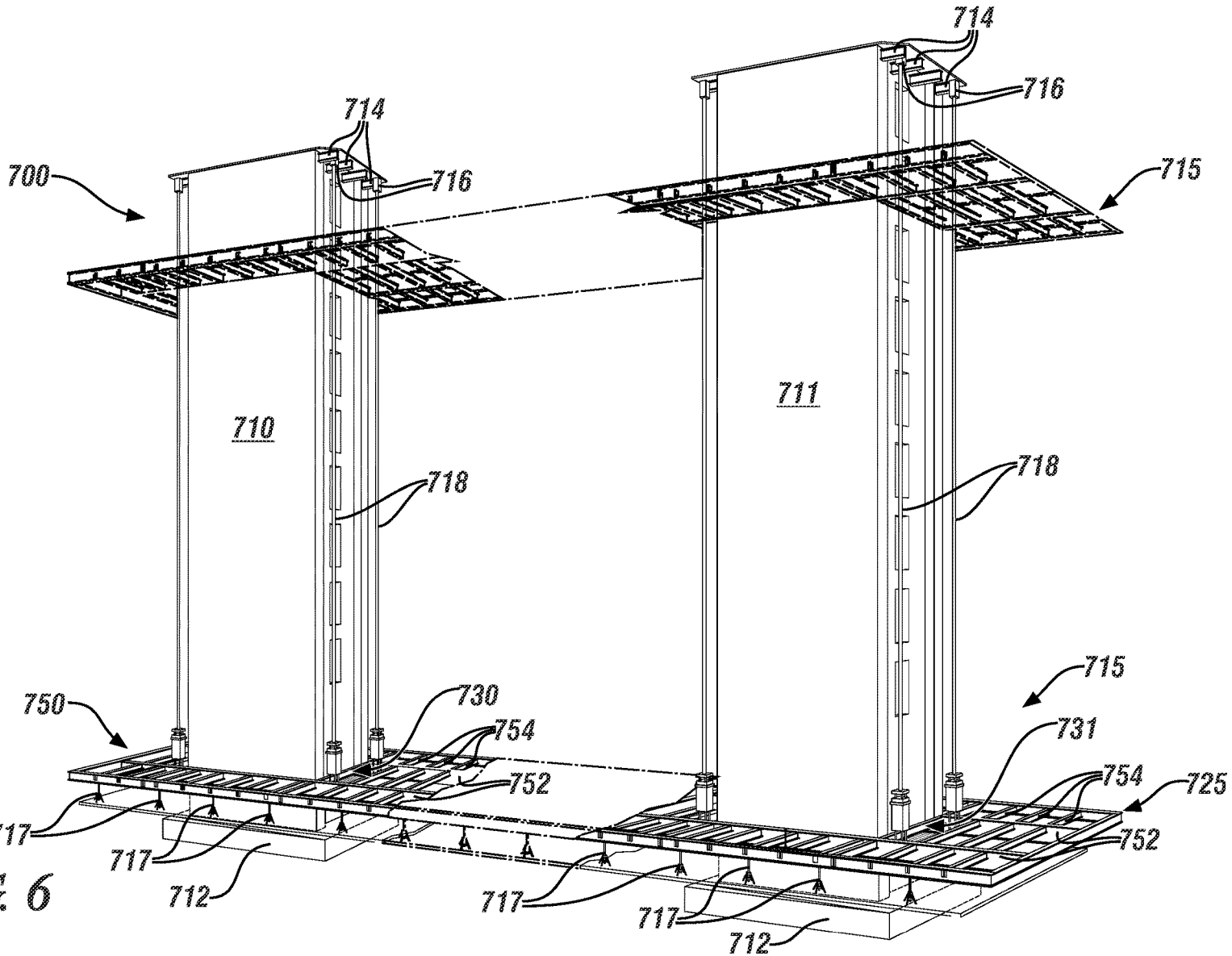
FIG. 6 is a side perspective isometric view of another embodiment of a partially constructed building, in accordance with the disclosure.

FIG. 6 schematically shows a partially assembled building 700, including first and second vertical support cores 710, 711 that project upwardly from base 712. A partially assembled floor plate 750 is disposed at an assembly level 725 and spans between the first and second vertical support cores 710, 711. The floor plate 750 also has cantilevered portions. The partially assembled building 700 includes first and second roof beams 714, 715, respectively, from which lifting jacks 716 are suspended. The lifting jacks 716 are attached via cables 718 to first and second bridles 730, 731, respectively, which are arranged on the first and second vertical support cores 710, 711, respectively. As shown, the partially assembled floor plate 750 is assembled onto the first and second bridles 730, 731 that are suspended from the lifting jacks 716. The first and second bridles 730, 731 are supported on stub columns (not shown) and the floor plate 750 is supported on pedestals 717 when at the assembly level 725. The floor plate 750 includes a pair of girders 752 that span between the first and second bridles 730, 731, and a plurality of framing members 754 that are arranged transverse to the girders 752. The floor plate 750 is assembled at the assembly level 725 and is lifted to its design elevation 715 on both the first and second vertical support cores 710, 711 by actions of the lifting jacks 716.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A reusable bridle for a floor plate of a building, comprising:

a plurality of lifting beams, a plurality of side beams, and a plurality of bearing pads;

wherein the plurality of lifting beams includes a first lifting beam and a second lifting beam, wherein the first lifting beam is arranged on a first side of the vertical support core, and wherein the second lifting beam is arranged on a second side of the vertical support core that is opposite to the first side;

wherein the plurality of side beams includes a first side beam and a second side beam, wherein the first side beam is arranged on a first end of the vertical support core, wherein the second side beam is arranged on a second end of the vertical support, wherein the first side beam is connected to first ends of the first lifting beam and the second lifting beam, and wherein the second side beam is connected to second ends of the first lifting beam and the second lifting beam;

wherein the plurality of side beams and the plurality of lifting beams are arranged around an outer periphery of a vertical support core of the building;

wherein the plurality of side beams are connected to the plurality of lifting beams;

wherein the plurality of lifting beams are configured to be attached to a plurality of lift jacks that are suspended from a plurality of cables that arranged on the vertical support core of the building; and wherein the plurality of bearing pads are disposed on the plurality of side beams.

2. The reusable bridle of claim 1, wherein the first side beam, the second side beam, the first lifting beam, and the second lifting beam are arranged such that upper surfaces of the first side beam and the second side beam are level with upper surfaces of the first lifting beam and the second lifting beam in a horizontal plane.

3. The reusable bridle of claim 1, wherein the plurality of bearing pads are movably disposed on the plurality of side beams to support girders of the floor plate during assembly thereof.

4. The reusable bridle of claim 1, wherein each of the plurality of lifting beams comprises one of an H-beam, an I-beam, a C-beam, a T-beam, an L-beam, a square beam, or a rectangular beam.

5. The reusable bridle of claim 1, wherein the each of the plurality of side beams comprises one of an H-beam, an I-beam, a C-beam, a T-beam, an L-beam, a square beam, or a rectangular beam.

6. The reusable bridle of claim 1, wherein the bridle is disposed on a base at an assembly level near ground elevation while assembling the floor plate thereon.

7. The reusable bridle of claim 1, comprising:

wherein the floor plate of the building is assembled on top of the bridle at an assembly level;

wherein the bridle and the floor plate are configured to be lifted on the vertical support core to a design elevation via the plurality of lift jacks; and wherein the bridle is configured to be lowered on the vertical support core to the assembly level subsequent to the floor plate being secured to the vertical support core at the design elevation.

8. A method for assembling a building, the method comprising:

arranging, at an assembly level, a bridle onto a vertical support core, wherein the bridle is disposed on a plurality of stub columns that are arranged on a base supporting the vertical support core;

positioning a plurality bearing pads on side beams of the bridle to correspond to girders of the floor plate;

attaching the bridle to a plurality of lift jacks that are suspended from a plurality of cables that arranged on the vertical support core; and assembling one of a plurality of floor plates onto the bridle at an assembly level proximal to the base;

wherein assembling the one of the plurality of floor plates comprises arranging the girders of the floor plate onto the plurality of bearing pads.

9. The method of claim 8, further comprising:

lifting, via the plurality of lift jacks, the bridle and the one of the plurality of floor plates on the vertical support core to a design elevation; and securing the floor plate to the vertical support core at the design elevation.

10. The method of claim 9, further comprising lowering, via the plurality of jacks, the bridle on the vertical support core to the assembly level after the floor plate is secured to the vertical support core at the design elevation.

11. The method of claim 9, further comprising sequentially assembling and lifting the plurality of the floor plates to respective design elevations relative to the vertical support core in a sequentially descending order.

12. The method of claim 8, wherein arranging, at the assembly level, the bridle onto the vertical support core comprises arranging the bridle around an outer periphery of the vertical support core of the building.

13. The method of claim 8, wherein arranging, at the assembly level, the bridle onto the vertical support core comprises:

suspending, via lift jacks, the bridle from cables that are arranged on the vertical support core of the building;

wherein the bridle comprises a plurality of lifting beams and a plurality of side beams; and wherein the plurality of lifting beams are suspended via the lift jacks from the cables that are arranged on the vertical support core of the building.

14. The method of claim 8, further comprising arranging the bridle onto stub columns disposed on the base subsequent to lowering the bridle to the assembly level.

15. A reusable bridle for assembling a building, comprising:

a plurality of lifting beams including a first lifting beam and a second lifting beam, and a plurality of side beams including a first side beam and a second side beam;

wherein the plurality of side beams and the plurality of lifting beams are arranged around an outer periphery of a vertical support core of the building, wherein the first lifting beam is arranged on a first side of the vertical support core, wherein the second lifting beam is arranged on a second side of the vertical support core that is opposite to the first side, wherein the first side beam is arranged on a first end of the vertical support core, wherein the second side beam is arranged on a second end of the vertical support, wherein the first side beam is connected to first ends of the first lifting beam and the second lifting beam and wherein the second side beam is connected to second ends of the first lifting beam and the second lifting beam;

wherein the plurality of side beams are connected to the plurality of lifting beams; and wherein the plurality of lifting beams are configured to be attached to a plurality of lift jacks that are suspended from a plurality of cables that arranged on the vertical support core of the building.

16. The reusable bridle of claim 15, comprising:

wherein the floor plate of the building is assembled on top of the reusable bridle at an assembly level;

wherein the bridle and the floor plate are configured to be lifted on the vertical support core to a design elevation via the plurality of lift jacks; and wherein the bridle is configured to be lowered on the vertical support core to the assembly level subsequent to the floor plate being secured to the vertical support core at the design elevation.

* * * * *